US006748878B2

(12) United States Patent
Chen

(10) Patent No.: US 6,748,878 B2
(45) Date of Patent: Jun. 15, 2004

(54) SHELF POSITIONING MECHANISM FOR SECTIONAL RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 139 days.

(21) Appl. No.: 10/047,721

(22) Filed: Jan. 13, 2002

(65) Prior Publication Data

US 2003/0131767 A1 Jul. 17, 2003

(51) Int. Cl.[7] ..... A47B 9/00
(52) U.S. Cl. ..... 108/147.13; 108/192; 211/187
(58) Field of Search ..... 108/147.17, 147.15, 108/147.13, 192, 193; 211/187, 181.1, 153

(56) References Cited

U.S. PATENT DOCUMENTS

| | | | | | |
|---|---|---|---|---|---|
| 3,523,508 | A | * | 8/1970 | Maslow | 108/147.13 |
| 3,604,369 | A | * | 9/1971 | Maslow | 108/147.13 |
| 3,675,598 | A | * | 7/1972 | Kesilman et al. | 108/147.13 |
| 3,757,705 | A | * | 9/1973 | Maslow | 108/147.13 |
| 4,799,818 | A | * | 1/1989 | Sudimak et al. | 108/147.13 |
| 5,127,342 | A | * | 7/1992 | Taylor | 108/147.13 |
| 5,390,803 | A | * | 2/1995 | McAllister | 108/147.13 |
| 6,079,575 | A | * | 6/2000 | Wang | 108/147.13 |
| 6,241,108 | B1 | * | 6/2001 | Nakatani et al. | 108/147.15 |

* cited by examiner

*Primary Examiner*—Jose V. Chen
(74) *Attorney, Agent, or Firm*—W. Wayne Liauh

(57) ABSTRACT

A shelf positioning mechanism for sectional rack constructed particularly from vertical posts having spaced horizontal annular grooves and horizontal shelves mainly includes a positioning member fitted between a short sleeve provided at each corner of the shelf and a connecting member configured to attach to the vertical post at the annular groove. The positioning member has downward and outward inclined inner wall surface that applies a clamping force on a downward and outward inclined outer wall surface of the connecting member for the latter to securely attach to the vertical post, and has a straight outer wall surface to tightly bear against a straight inner wall surface of the short sleeve for the shelf to be selectively turned upside down when it is assembled to the vertical posts.

1 Claim, 6 Drawing Sheets

SHELF POSITIONING MECHANISM FOR SECTIONAL RACK

BACKGROUND OF THE INVENTION

The present invention relates to a shelf positioning mechanism for sectional rack, and more particularly to a shelf positioning mechanism that allows the same shelves of a sectional rack to be selectively turned upside down when they are assembled onto vertical posts of the sectional rack.

A sectional rack that can be assembled and erected without the need of any tool is most welcomed by consumers. Such sectional rack usually includes many metal tubes as its posts, and these posts are provided with a plurality of spaced annular grooves, making the posts looked like bamboo poles. The sectional rack also includes a plurality of horizontal shelves being assembled onto the posts by putting short sleeves provided at corners of each shelf around connecting members previously attached to the posts at the annular grooves. U.S. Pat. Nos. 5,676,263; 5,303,645; 5,174,676; 4,991,725; 4,799,818; 4,595,107; 5,546,887; and 4,763,799 all disclose sectional racks using such bamboo pole-like tubes as the posts of the rack. Please refer to FIG. 1. The above-described conventional sectional rack includes vertical posts 10 with annular grooves 11 spaced on an outer wall thereof for engaging with ribs 21 provided on an inner wall surface of the connecting members 20, so that the connecting members 20 are attached to the posts 10 at the annular grooves 11. Each of the connecting members has varying outer diameters gradually increased from top to bottom. Each of the shelves 30 has a short sleeve 31 provided at each corner thereof (only two of four corners are shown in the drawing). The short sleeve 31 has varying inner diameters gradually increased from top to bottom corresponding to the varying outer diameters of the connecting members 20. When the shelf 30 is assembled onto the vertical posts 10, the short sleeves 31 are put around the connecting members 20 to tightly clamp the latter against the posts 10 at the annular grooves 11 and therefore hold the shelf 30 to the posts 10 at four corners.

The shelf 30 shown in FIG. 1 includes a plurality of horizontal metal wires 32 that together form a carrying surface at an open upper side of the shelf 30. The shelf 30 with the carrying surface formed at the open upper side thereof is referred to as a regular shelf, and things laid on the regular shelf 30 are completely visible. However, the sectional rack may also have shelves 30' that include a plurality of horizontal metal wires 32' forming a carrying surface at an enclosed lower side of the shelf 30', as shown in FIG. 2. The shelf 30' with the carrying surface formed at the enclosed lower side thereof is referred to as a reverse shelf, and things laid on the reverse shelf are protected from falling out of the shelf. The regular and the reverse shelves 30, 30' have their respective advantages and are selected for use depending on users' actual need and preference. However, it is troublesome but necessary for a sectional rack manufacturer to decide and produce the required numbers of the regular and the reverse shelves 30, 30' for constructing a set of the above-described sectional rack according to a customer's order.

SUMMARY OF THE INVENTION

It is a primary object of the present invention to provide a shelf positioning mechanism for sectional rack that enables the same one shelf to be used either as a regular or a reverse shelf when the shelf is assembled onto posts of the sectional rack.

To achieve the above and other objects, the shelf positioning mechanism for sectional rack according to the present invention mainly include a positioning member to be fitted between the short sleeve provided at each corner of the shelf and the connecting member configured to attach to the vertical post at the annular groove. The positioning member has downward and outward inclined inner wall surface that applies a clamping force on the downward and outward inclined outer wall surface of the connecting member, and has straight outer wall surface to tightly bear against a straight inner wall surface of the short sleeve. Therefore, the same shelf can be selectively turned upside down when it is assembled onto the vertical posts.

The positioning member is provided around a lower end with radially outward projected flanges, on which the short sleeve of the shelf is rested to ensure tight fitness of the straight inner wall surface of the short sleeve with the straight outer wall surface of the positioning member.

In a preferred embodiment, the positioning member includes two complementary parts that are closable to each other to form a hollow cylindrical member, such that when the positioning member is put around the connecting member and subjected to a resistance from the connecting member, it is slightly expanded to tightly bear against the inner wall surface of the short sleeve, causing the connecting member, the positioning member, and the short sleeve to form a sequentially and securely connected unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
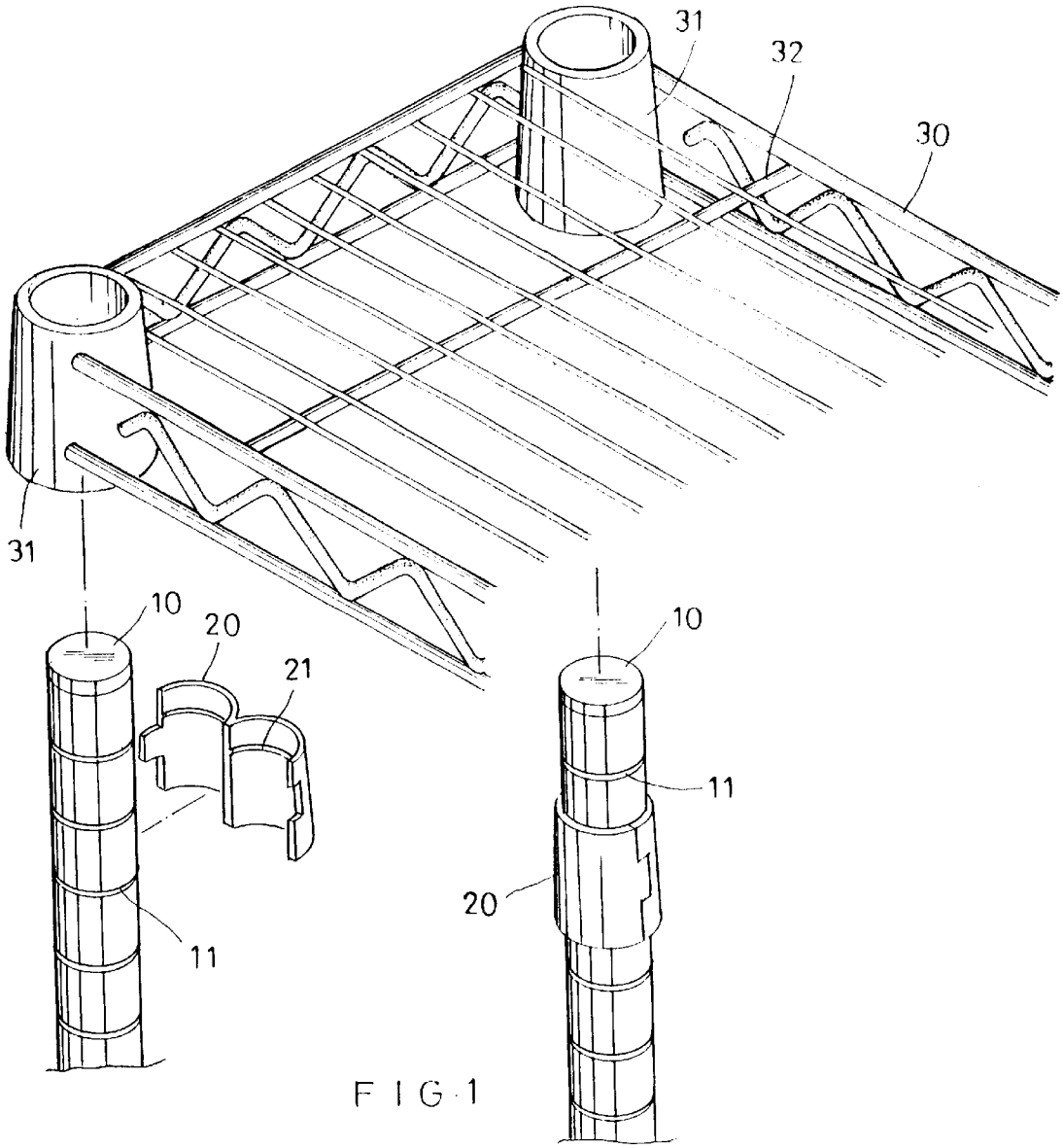
FIG. 1 is a fragmentary, exploded perspective view of a conventional shelf positioning mechanism for a sectional rack.
Figure 2:
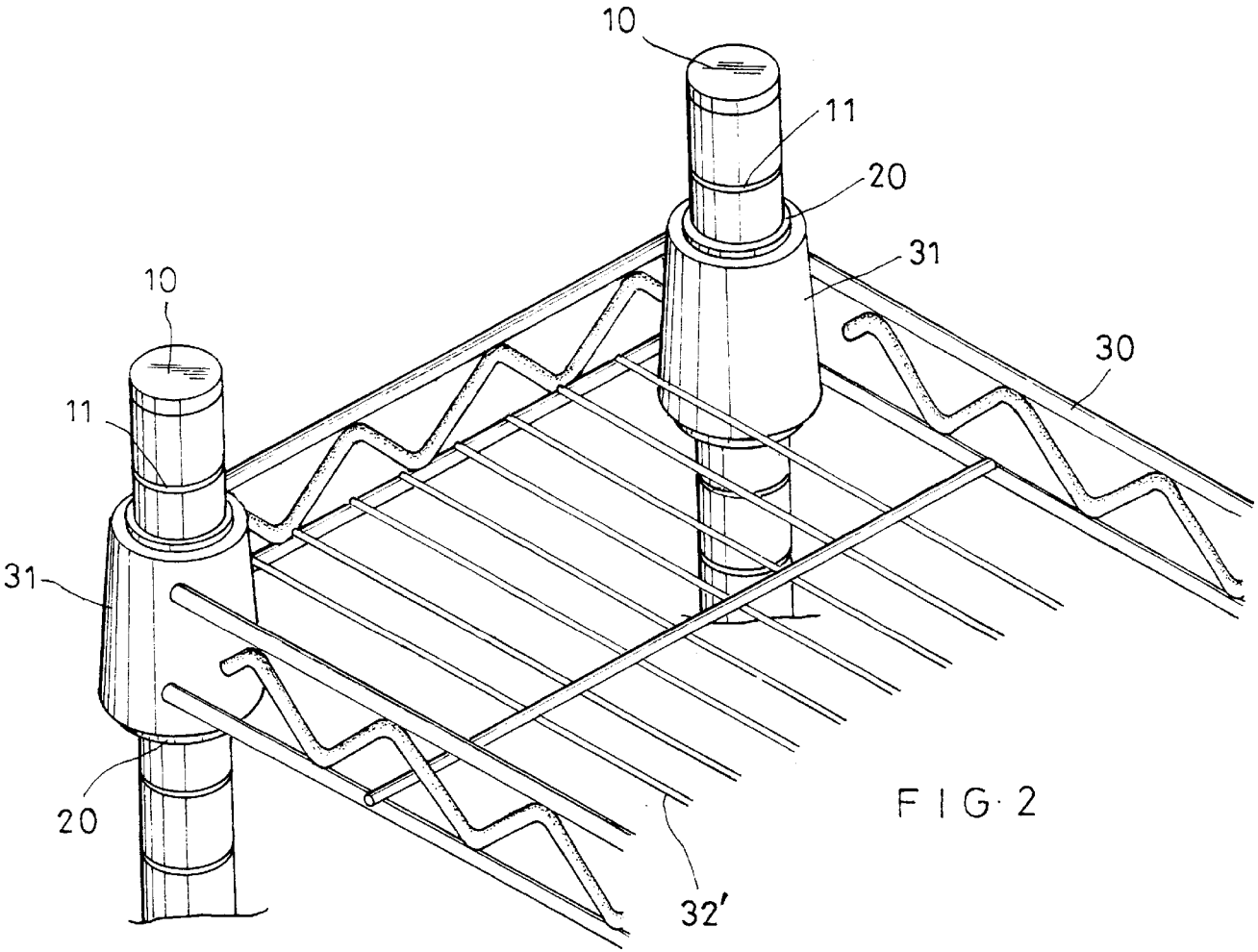
FIG. 2 is a fragmentary, assembled perspective view of the shelf positioning mechanism of FIG. 1, wherein the shelf is different from that of FIG. 1.
Figure 3:
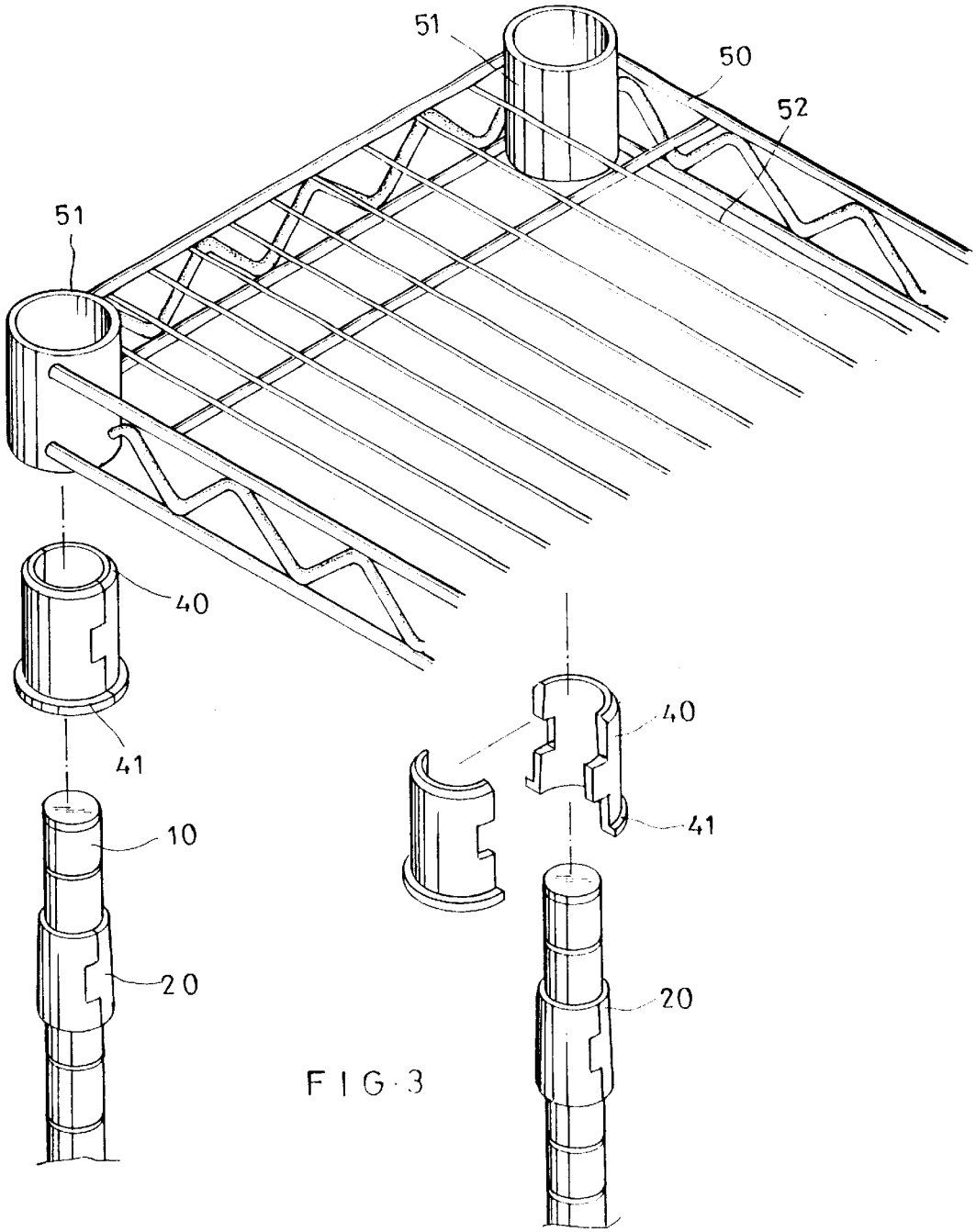
FIG. 3 is a fragmentary, exploded perspective view of a shelf positioning mechanism for sectional rack according to the present invention.

Please refer to FIG. 3 that is a fragmentary, exploded perspective view of a shelf positioning mechanism for sectional rack according to an embodiment of the present invention. As shown, the sectional rack is assembled mainly from a plurality of vertical posts 10, a plurality of horizontal shelves 50, a plurality of connecting members 20, and a plurality of positioning members 40.

Each of the vertical posts 10 is provided around an outer surface with a plurality of spaced horizontal annular grooves 11. Each of the connecting members 20 is provided on an inner wall surface with two corresponding ribs 21 adapted to engage into the annular grooves 11 and thereby fixing the connecting member onto the vertical posts 10. The connecting member 20 has varying outer diameters gradually increased from top to bottom and therefore a downward and outward inclined outer wall surface. The manner of attachment of the connecting members 20 to the vertical posts 10 is known and is therefore not described in details herein.

Each of the positioning members 40 includes two complementary parts that could be closed to each other to form a hollow cylindrical member. The two parts of the positioning member 40 are provided at respective lower ends with radially outward projected flanges 41. The positioning member 40 has varying internal diameters gradually increased from top to bottom and therefore a downward and outward inclined inner wall surface. On the other hand, the positioning member 40 has a uniform outer diameter and therefore a straight outer wall surface.

Each of the shelves 50 has a short sleeve 51 provided at each corner thereof. The short sleeve 51 has a uniform internal diameter and therefore a straight inner wall surface.

Figure 4:
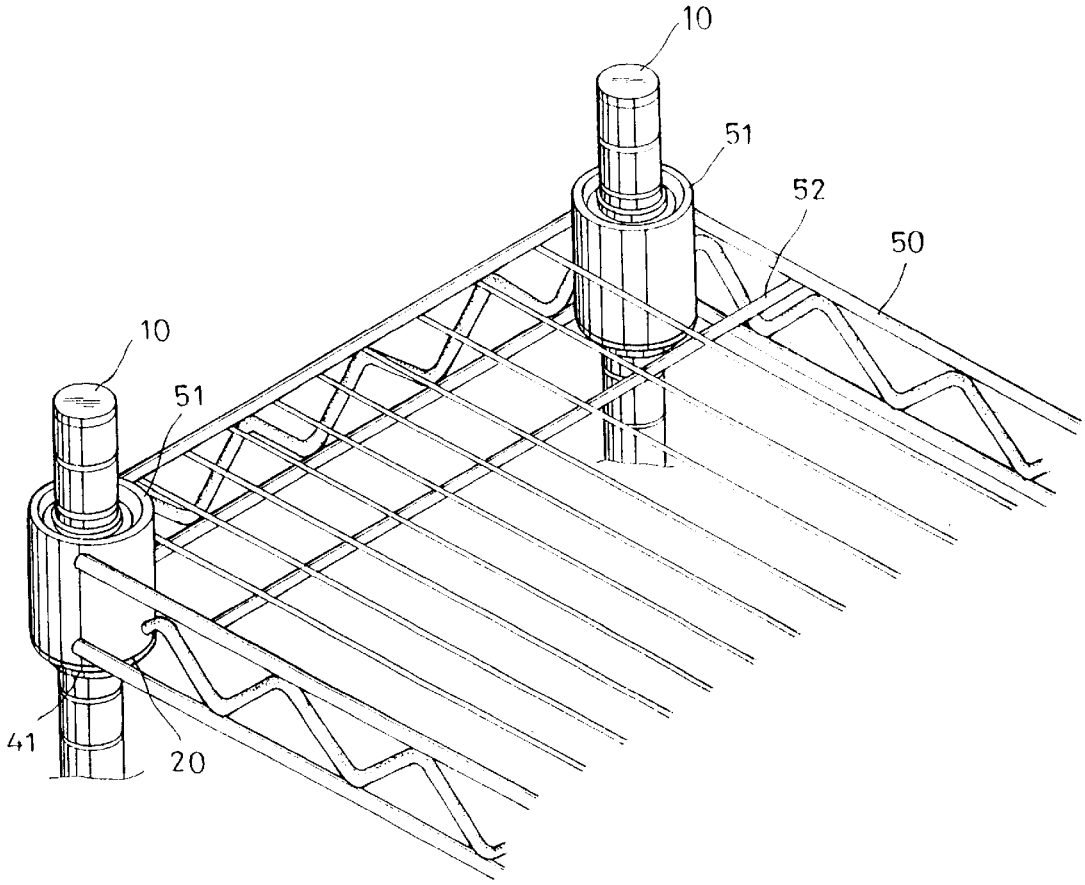
FIG. 4 is a fragmentary, assembled perspective view of FIG. 3.
Figure 5:
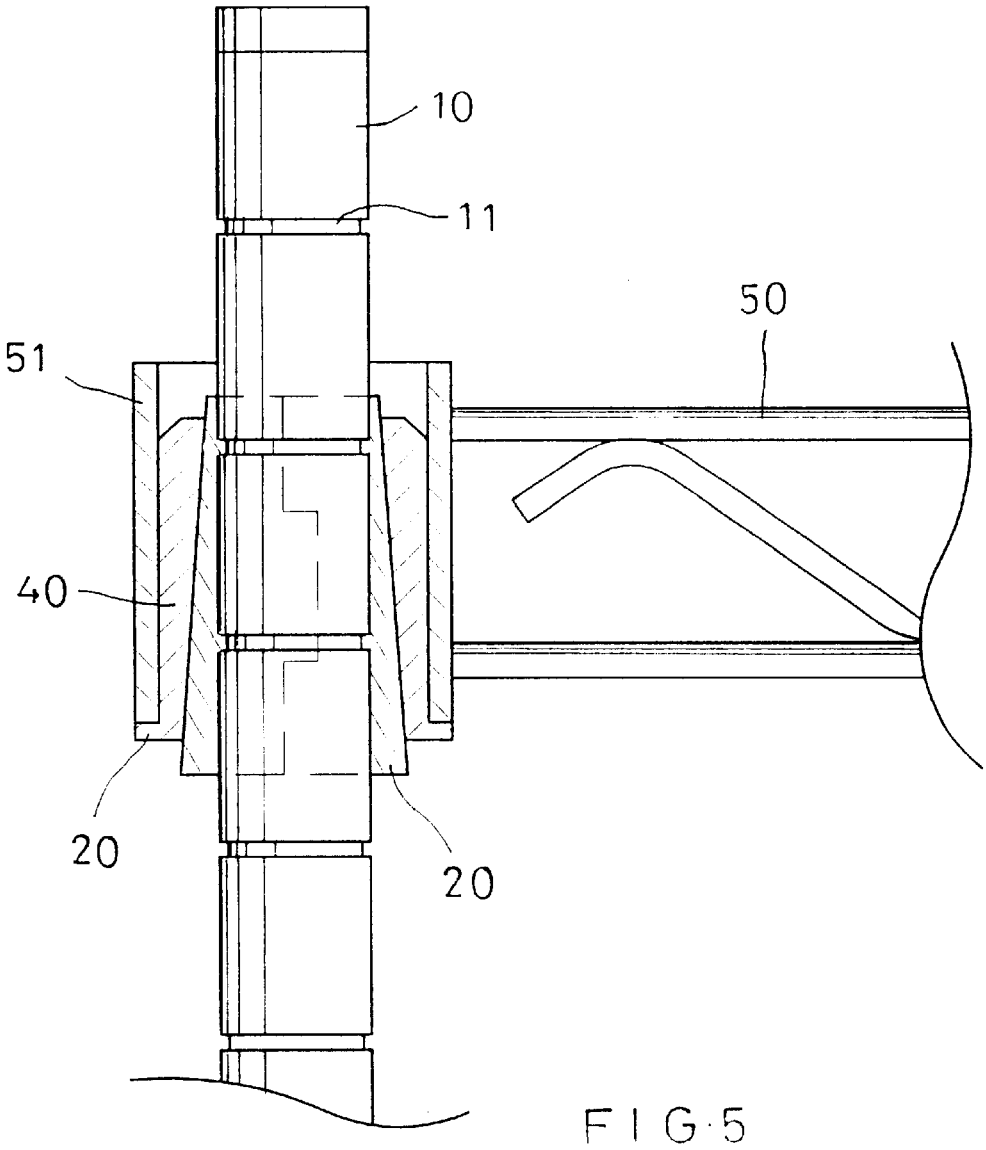
FIG. 5 is a fragmentary, partially sectioned side view of FIG. 3.

Please refer to FIGS. 4 and 5. The positioning member 40 is dimensioned to tightly fit in the short sleeve 51 of the shelf 50 while fitly enclose the connecting member 20. The inclined inner wall surface of the positioning member 40 applies a clamping force on the inclined outer wall surface of the connecting member 20. Thereby, the short sleeve 51 of the shelf 50, the positioning member 40, and the connecting member 20 are sequentially firmly and tightly pressed against the vertical post 10, allowing the short sleeve 51 at each corner of the shelf 50 to fixedly position on the vertical post 10. When the short sleeves 51 at four corners of the shelf 50 are separately fixed to four vertical posts 10 at positions of the same height, the shelf 50 is connected to the sectional rack for holding things.

More specifically, the straight outer wall surface of the positioning member 40 is confined by the short sleeve 51, and the inclined inner wall surface of the positioning member 40 tightly bears against the inclined outer wall of the connecting member 20 to confine the latter to the vertical post 10. That is, there is not any clearance between contact surfaces of the short sleeve 51 and the positioning member 40, and of the positioning member 40 and the connecting member 20. The positioning member 40 is on the one hand slightly outward expanded due to a resistance from the connecting member 20, and on the other hand inward compressed due to a compression force from the short sleeve 51. When the resistance from the connecting member 20 and the compression force from the short sleeve 51 reach a balanced point, a secured positioning effect is obtained.

When the shelf 50 is assembled onto the vertical posts 10, the short sleeves 51 at four corners of the shelf 50 are rested on the flanges 41 of corresponding positioning members 40. Since the flanges 41 are configured to support and bear weights of the short sleeves 51, it is preferable the positioning members 40 are made of heavy-duty plastic material or cast metal material.

Figure 6:
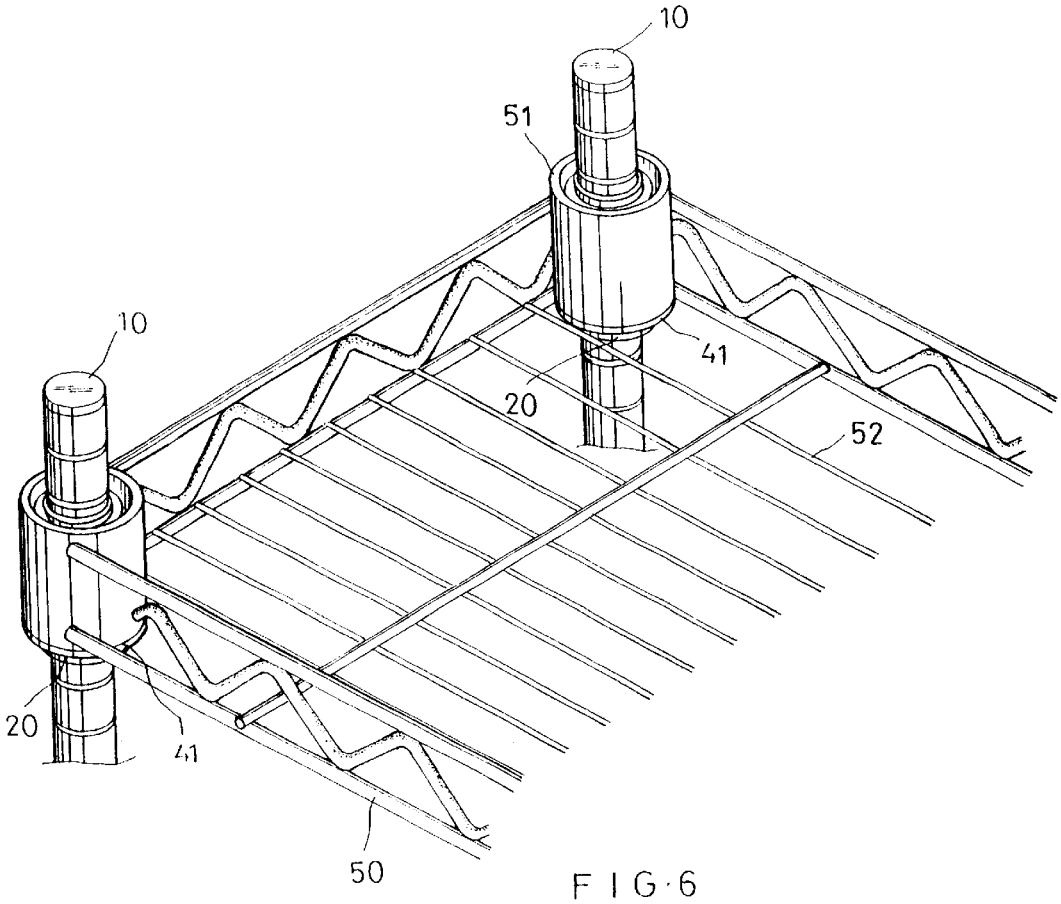
FIG. 6 is similar to FIG. 3 but with the shelf of the sectional rack mounted in an upside-down position.

The shelf 50 includes a plurality of metal wires 52 that together form a carrying surface for holding things. The shelf 50 may be assembled onto the vertical posts 10 as a regular shelf, that is, with the carrying surface forming an open top of the shelf 50 as shown in FIG. 4, or as a reverse shelf, that is, with the carrying surface forming an enclosed bottom of the shelf 50 as shown in FIG. 6. It is no need for a sectional rack manufacturer to note how many regular and reverse shelves 50 should be produced for constructing a customized sectional rack. In brief, with the shelf positioning mechanism of the present invention, particularly the positioning member thereof, the shelf 50 can be conveniently used either as a regular shelf or a reverse shelf, completely depending on a user's actual need. The manufacturer needs only to produce one type of shelf 50 and users may selectively assemble the same shelf 50 to the vertical posts 10 with the carrying surface thereof facing upward or downward as desired.

What is claimed is:

1. A shelf positioning mechanism for a sectional rack constructed from a plurality of vertical posts and a plurality of horizontal shelves, comprising short sleeves provided at four corners of each of said shelves, horizontal annular grooves spaced on outer surface of each of said vertical posts, connecting members having varying outer diameters gradually increased from top to bottom to provide a downward and outward inclined outer wall surface and being adapted to attach to said vertical posts through engagement of ribs provided on inner wall surfaces of said connecting members with said annular grooves, and positioning members adapted to fit in said short sleeves while enclose said connecting members;

said shelf positioning mechanism being characterized in that each of said positioning members includes two complementary parts that are closable to each other to form a hollow cylindrical member having varying inner diameters gradually increased from top to bottom to provide a downward and outward inclined inner wall surface and a uniform outer diameter to provide a straight outer wall surface, and are provided at respective lower ends with radially outward extended flanges; and that each of said short sleeves provided at four corners of said horizontal shelves has a uniform inner diameter to provide a straight inner wall surface and is configured to rest on said flanges of each said positioning member;

whereby when each of said positioning members is fitted in said short sleeve to enclose said connecting member, said straight inner wall surface of said short sleeve applies a compression force on said straight outer wall surface of said positioning member, and said inclined inner wall surface of said positioning member applies a clamping force on said inclined outer surface of said connecting member, allowing said short sleeve, said positioning member, and said connecting member to sequentially and securely bear against said vertical post and thereby positioning said horizontal shelf in place on said vertical post to construct said sectional rack without the need of any other fastening means.

* * * * *